US012729522B2

(12) United States Patent
Zhang et al.

(10) Patent No.: US 12,729,522 B2
(45) Date of Patent: Sep. 8, 2026

(54) JOINT STRUCTURE CONFIGURED FOR PULL-OUT TUBE, PULL-OUT TUBE STRUCTURE, AND FAUCET

(71) Applicants: Xiamen Lota International Co., Ltd., Xiamen (CN); Lota Xiamen Industry Co. Ltd., Xiamen City (CN)

(72) Inventors: Yan Zhang, Xiamen (CN); Liming Ye, Xiamen (CN); Chuanbao Zhu, Xiamen (CN)

(73) Assignees: Xiamen Lota International Co., Ltd., Xiamen (CN); Lota Xiamen Industry Co. Ltd., Xiamen City (CN)

( * ) Notice: Subject to any disclaimer, the term of this patent is extended or adjusted under 35 U.S.C. 154(b) by 56 days.

(21) Appl. No.: 19/003,583

(22) Filed: Dec. 27, 2024

(65) Prior Publication Data

US 2026/0117501 A1 Apr. 30, 2026

(30) Foreign Application Priority Data

May 31, 2024 (CN) ..... 202410698547.7

(51) Int. Cl.
*E03C 1/04* (2006.01)
*E03C 1/05* (2006.01)

(52) U.S. Cl.
CPC ..... *E03C 1/0404* (2013.01); *E03C 1/057* (2013.01); *E03C 2001/0415* (2013.01); *Y10T 137/9464* (2015.04)

(58) Field of Classification Search
CPC .... F16K 31/082; F16K 31/086; E03C 1/0404; E03C 1/04; E03C 2001/0415; E03C 1/057; E03C 1/05; G01D 5/145; G01D 5/142
See application file for complete search history.

(56) References Cited

U.S. PATENT DOCUMENTS

| | | | | |
|---|---|---|---|---|
| 9,315,975 | B2 * | 4/2016 | Davidson | E03C 1/04 |
| 9,637,895 | B2 * | 5/2017 | Song | E03C 1/0404 |
| 10,260,216 | B2 * | 4/2019 | Zhu | E03C 1/0404 |
| 10,612,221 | B2 * | 4/2020 | Yan | A47L 15/449 |
| 11,473,279 | B2 * | 10/2022 | Lu | E03C 1/0404 |
| 11,566,404 | B2 * | 1/2023 | Peng | E03C 1/0404 |
| 11,761,181 | B2 * | 9/2023 | Chen | E03C 1/0404 4/619 |
| 11,781,300 | B2 * | 10/2023 | Yan | E03C 1/0401 4/623 |
| 11,821,184 | B2 * | 11/2023 | Tracy | E03C 1/0404 |

(Continued)

FOREIGN PATENT DOCUMENTS

| | | | | |
|---|---|---|---|---|
| CN | 204878977 U | * | 12/2015 | |
| CN | 116292991 A | * | 6/2023 | F16K 11/24 |

*Primary Examiner* — David Colon-Morales
(74) *Attorney, Agent, or Firm* — Cooper Legal Group, LLC

(57) ABSTRACT

A joint structure configured for a pull-out tube, a pull-out tube structure, and a faucet. The joint structure includes a joint body, two connecting heads respectively disposed on two ends of the joint body, a magnetic component, and an embedded member. The two connecting heads are configured to be connected to the pull-out tube. The magnetic component is sleeved on an outside of the joint body by a first insert molding process, and an outside of the magnetic component is partially encased in the joint body. The magnetic component is partially exposed outside the joint body to form an exposed space, and the embedded member is molded on the exposed space by a second insert molding process. The joint body and the embedded member are combined to encase the magnetic component.

10 Claims, 8 Drawing Sheets

(56) References Cited

U.S. PATENT DOCUMENTS

| | | | | |
|---|---|---|---|---|
| 12,043,995 | B2 * | 7/2024 | Liao | E03C 1/057 |
| 12,139,895 | B2 * | 11/2024 | Yang | E03C 1/057 |
| 2019/0330828 | A1 * | 10/2019 | Yan | E03C 1/025 |
| 2024/0401313 | A1 * | 12/2024 | Chen | E03C 1/0404 |

* cited by examiner

JOINT STRUCTURE CONFIGURED FOR PULL-OUT TUBE, PULL-OUT TUBE STRUCTURE, AND FAUCET

RELATED APPLICATIONS

This application claims priority to Chinese patent application number 202410698547.7, filed on May 31, 2024. Chinese patent application number 202410698547.7 is incorporated herein by reference.

FIELD OF THE DISCLOSURE

The present disclosure relates to a joint structure configured for a pull-out tube, a pull-out tube structure, and a faucet.

BACKGROUND OF THE DISCLOSURE

The pull-out faucet allows users to freely move the pull-out head for water flow, making it easier for the users to perform cleaning, which is why it is highly favored by consumers. Existing pull-out faucets generally control a water flow using a manual valve core, which still has some inconveniences in use. To address this, electronic pull-out faucets have been developed. These electronic faucets allow the water flow to be discharged when the pull-out head is pulled out, and allow the water flow to be stopped when the pull-out head is reset to an initial position, providing more convenience in use. The existing electronic pull-out faucets are equipped with a magnetic switch assembly and a solenoid valve to control whether the water flows through the pull-out hose. The pull-out head is connected to the water outlet end of the pull-out hose. The magnetic switch assembly comprises a magnet and a magnetic sensor for detecting the magnet. The magnet is installed on the pull-out hose, and the magnetic sensor is positioned on the faucet body. When the pull-out head is in the initial position, the magnetic sensor detects the magnet, causing the solenoid valve to be turned off to stop the water flow. When the pull-out head is pulled out, the pull-out hose is moved, the magnet is moved, and the magnetic sensor no longer detects the magnet, causing the magnetic sensor to turn on the solenoid valve and allow the water to flow.

Chinese utility model CN204878977U discloses an intelligent control faucet, which includes a magnetic sensing device and an infrared sensor. The magnetic sensing device is installed on the water pipeline and is connected to the intelligent control module via a feeder or directly connected to the intelligent control module. The magnetic starting mechanism is a magnetic ring placed on the pull-out hose. The pull-out hose comprises a first hose and a second hose, and the magnetic starting mechanism is placed between the first hose and the second hose. The connection end of the first hose is fixedly disposed with a metal male connector, and the connection end of the second hose has a metal female connector, forming a sealed connection and a sleeved connection between the metal male connector and the metal female connector. The magnetic ring is sleeved on the metal male connector. When the pull-out hose returns to the initial position on the faucet body and the magnetic ring is in the area, a Hall element is turned off. In this utility model, the magnetic ring is exposed directly on the pull-out hose, making the magnetic ring vulnerable to collisions and cracks during a pulling out process. To ensure the integrity of the pull-out hose and protect the pull-out hose, a protective sleeve is added around the metal male connector, the metal female connector, and the magnetic ring. This increases costs and also enlarges a diameter of the connector, which may affect the smoothness of pulling out the pull out hose (i.e., a diameter of the pull out hose is enlarged to accommodate the diameter of the connector).

BRIEF SUMMARY OF THE DISCLOSURE

The purpose of the present disclosure is to overcome the shortcomings of the existing techniques mentioned above, addressing issues such as the magnet being exposed, which leads to collisions with an inner cavity of a faucet during operation, causing cracks and noise. The present disclosure enables pulling out of a pull-out tube to be smooth by minimizing an external diameter of a joint structure containing a magnetic component while maintaining flow capacity. The present disclosure provides the joint structure configured for the pull-out tube, a pull-out tube structure, and the faucet.

In order to solve the above technical problems, the present disclosure provides a joint structure configured for a pull-out tube comprising a joint body, two connecting heads respectively disposed on two ends of the joint body, a magnetic component, and an embedded member. The two connecting heads are configured to be connected to the pull-out tube.

The magnetic component is sleeved on an outside of the joint body by a first insert molding process, and an outside of the magnetic component is partially encased in the joint body. The magnetic component is partially exposed outside the joint body to form an exposed space, and the embedded member is molded on the exposed space by a second insert molding process. The joint body and the embedded member are combined to encase the magnetic component.

In a preferred embodiment, a part of the joint body encasing the outside of the magnetic component comprises a first connecting flange and a plurality of first encasing walls, and the first connecting flange is formed on one end of the magnetic component along an axial direction of the joint structure. The plurality of first encasing walls encase an outer wall of the magnetic component, and one end of the plurality of first encasing walls is connected to the first connecting flange. The plurality of first encasing walls are arranged at intervals along a circumferential direction of the magnetic component, and gaps between two adjacent first encasing walls of the plurality of first encasing walls form the exposed space.

In a preferred embodiment, the embedded member comprises a second connecting flange and a plurality of second encasing walls, and the second connecting flange is formed on a second end of the magnetic component in the axial direction of the joint structure. The plurality of second encasing walls encase the outer wall of the magnetic component, and one end of the plurality of second encasing walls is connected to the second connecting flange. The plurality of second encasing walls are formed between the two adjacent first encasing walls of the plurality of first encasing walls to be fixedly connected to the plurality of first encasing walls.

In a preferred embodiment, an outer wall of the plurality of first encasing walls is flush with an outer wall of the plurality of second encasing walls.

In a preferred embodiment, the plurality of first encasing walls and the plurality of second encasing walls form a cylindrical structure, and a diameter of the cylindrical structure is the same as an outer diameter of the pull-out tube.

In a preferred embodiment, an inner wall of the magnetic component is embedded in the joint body, and the outer wall of the magnetic component is embedded in the plurality of first encasing walls and the plurality of second encasing walls.

A joint structure configured for a pull-out tube comprises a joint body, two connecting heads respectively disposed on two ends of the joint body, and a magnetic component. The two connecting heads are configured to be connected to the pull-out tube, and the magnetic component is sleeved on an outside of the joint body by an insert molding process. The joint body entirely encases an outside of the magnetic component, and one or more positioning holes exposing the magnetic component are formed on the joint body during the insert molding process. The one or more positioning holes are configured to enable a mould to position the magnetic component.

In a preferred embodiment, the pull-out tube comprises a first tube section and a second tube section, and the two connecting heads of the joint structure are respectively disposed in the first tube section and the second tube section.

A faucet comprises the pull-out tube structure and a magnetic switch. The magnetic component of the pull-out tube structure is configured to correspond to the magnetic switch.

Compared with the existing techniques, the technical solution has the following advantages.

The magnetic component is sleeved on the outside of the joint body by insert molding. The outside of the magnetic component is partially encased in the joint body, and the magnetic component is partially exposed outside the joint body to form the exposed space. The embedded member is molded on the exposed space by insert molding, and the joint body and the embedded member are combined to encase the magnetic component. The magnetic component is fixedly connected to the joint body by performing two insert molding processes, so that a water-passing part of the joint body has a double-wall thickness to prevent a thickness of the joint body from being relatively thin after the magnetic component is disposed on the joint. Under a premise of ensuring a flow rate in the joint structure, a diameter of the joint body can be minimized, which is conducive to pulling out the pull-out tube. An appearance of the joint structure is neat, the integrity is good, the joint structure is more beautiful, and the joint structure is more conducive to manufacture.

The joint structure configured for the pull-out tube comprises the joint body and the two connecting heads respectively disposed on the two ends of the joint body. The two connecting heads are configured to be connected to the pull-out tube, and the joint structure further comprises the magnetic component. The magnetic component is sleeved on the outside of the joint body by the insert molding process, and the joint body entirely encases the outside of the magnetic component. The one or more positioning holes exposing the magnetic component are formed on the joint body during the insert molding process, and the one or more positioning holes are configured to enable the mould to position the magnetic component. The magnetic component can be encased by insert molding only once, and the process is simple.

DETAILED DESCRIPTION OF THE EMBODIMENTS

Figure 1:
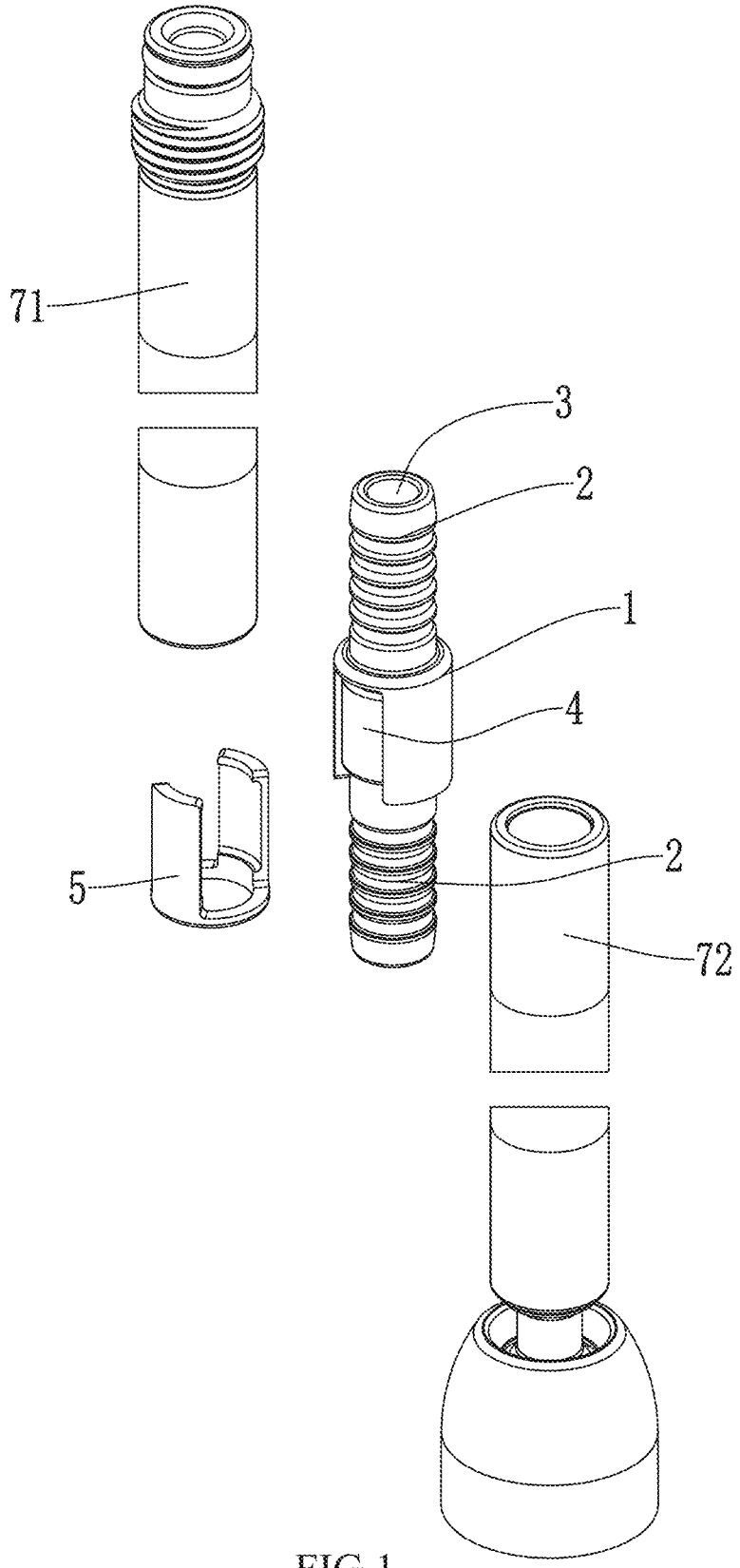
FIG. 1 is a perspective, exploded view of a pull-out tube structure in a preferred embodiment of the present disclosure.
Figure 2:
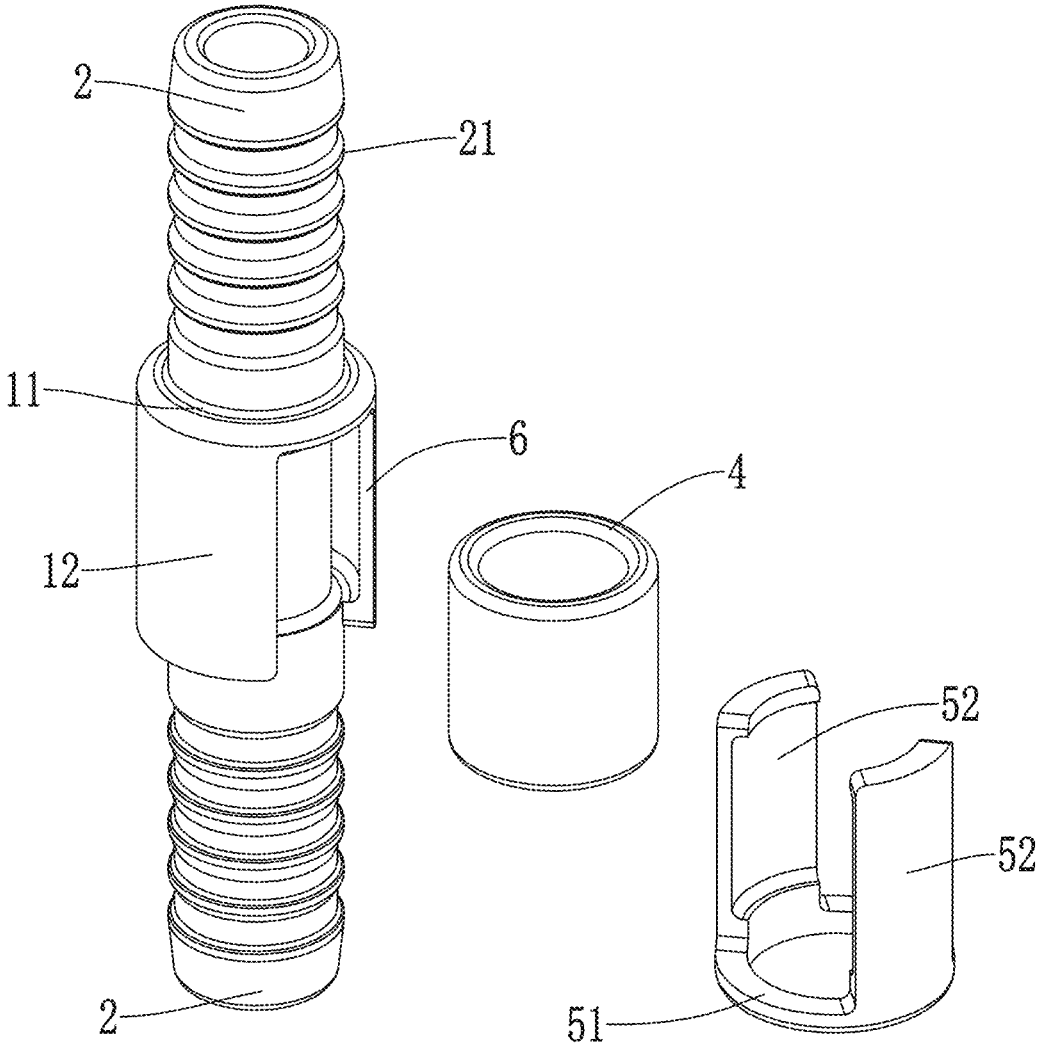
FIG. 2 is a perspective, exploded view of a joint structure in the preferred embodiment of the present disclosure.
Figure 3:
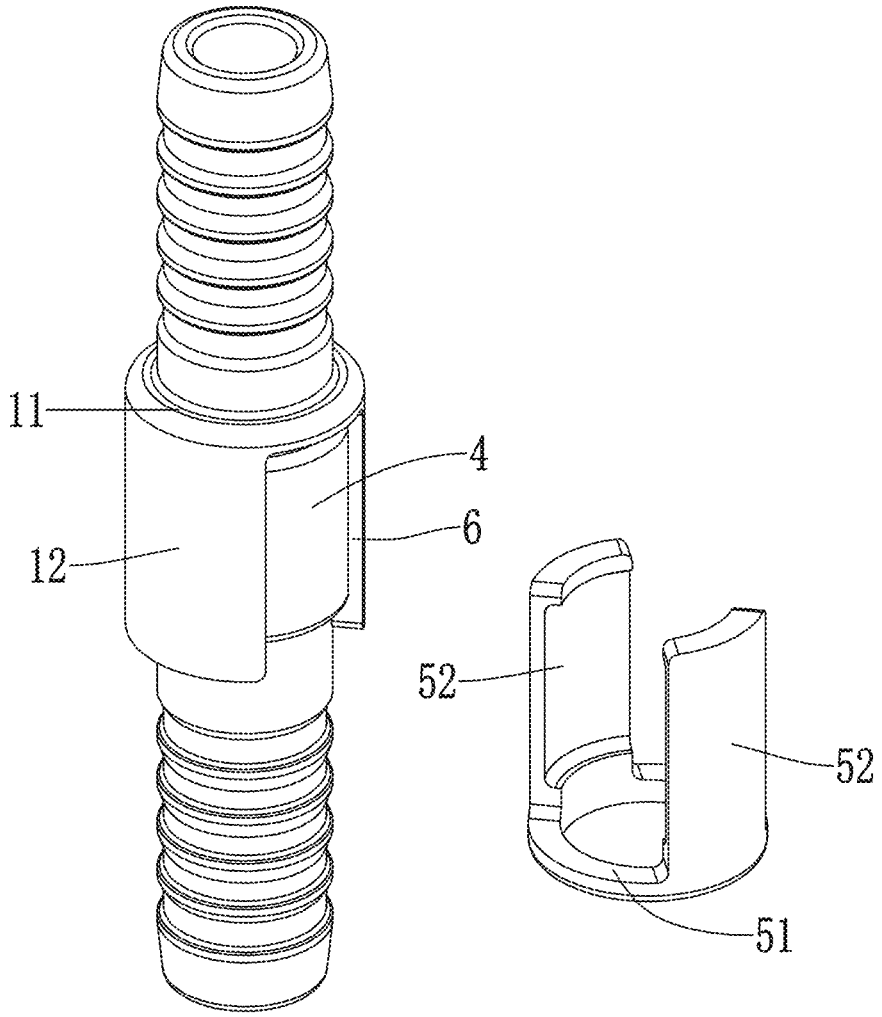
FIG. 3 is a perspective, exploded view of the joint structure in the preferred embodiment of the present disclosure.
Figure 4:
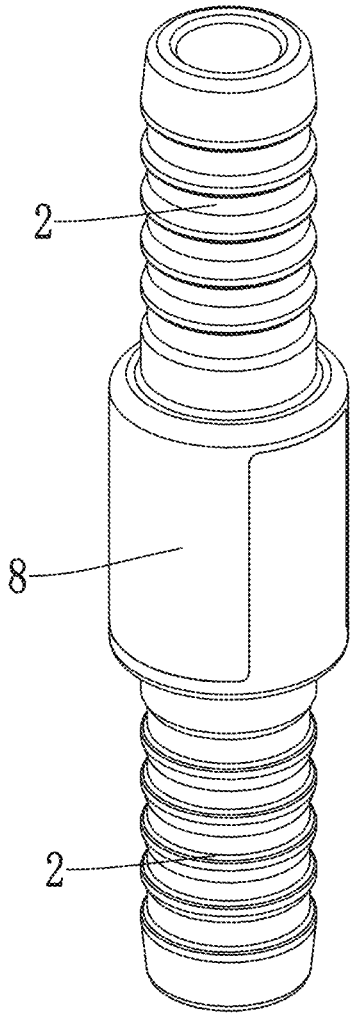
FIG. 4 is a perspective view of the joint structure in the preferred embodiment of the present disclosure.
Figure 5:
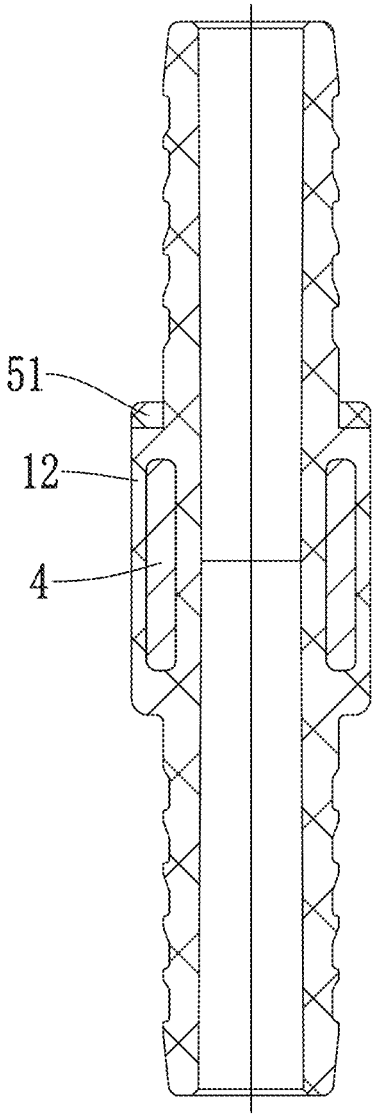
FIG. 5 is a cross-sectional view of the joint structure in the preferred embodiment of the present disclosure.
Figure 6:
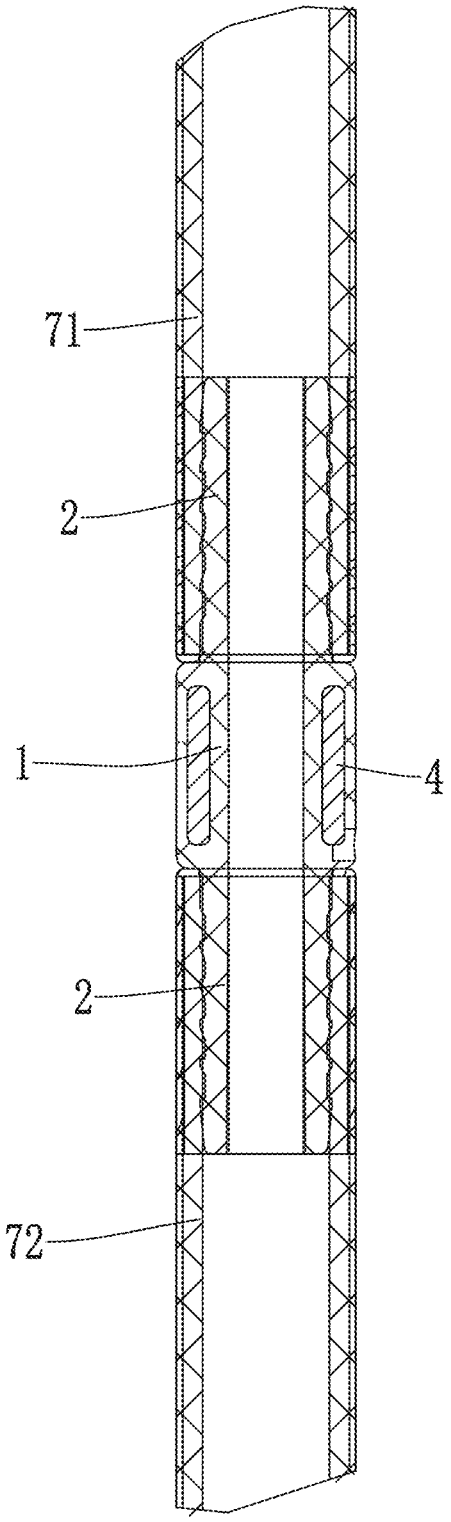
FIG. 6 is a cross-sectional view of the joint structure and two segmented pull-out tubes of a pull-out tube in the preferred embodiment of the present disclosure.

The present disclosure is further described below in conjunction with the accompanying drawings and specific embodiments.

Referring to FIGS. 1-6, a joint structure configured for a pull-out tube comprises a joint body 1 and two connecting heads 2 respectively disposed on two ends of the joint body 1. A diameter of each of the two connecting heads 2 is smaller than a diameter of the joint body 1. An outer wall of each of the two connecting heads 2 is disposed with a plurality of annular bodies 21 arranged at intervals along an axial direction of the joint structure. Each of the two connecting heads 2 can be inserted into the pull-out tube. The joint structure comprises an internal flow channel 3, and the internal flow channel 3 is connected to the two connecting heads 2. Two segmented pull-out tubes of the pull-out tube can be connected to each other through the joint structure.

The joint structure further comprises a magnetic component 4 and an embedded member 5. The magnetic component 4 is sleeved on an outside of the joint body 1 by insert molding. An outside of the magnetic component 4 is partially encased in the joint body 1, and the magnetic component 4 is partially exposed outside the joint body 1 to form an exposed space 6. The embedded member 5 is molded on the exposed space 6 by insert molding, and the joint body 1 and the embedded member 5 are combined to encase the magnetic component 4. The magnetic component 4 is fixedly connected to the joint body 1 by performing two insert molding processes, so that a water-passing part of the joint body 1 has a double-wall thickness to prevent a thickness of the joint body 1 from being relatively thin after the magnetic component 4 is disposed on the joint body 1. In this way, mechanical strength of the joint structure can be ensured, and assembly steps can be avoided. Since a need for a matching structure and assembly gaps are omitted, a diameter of the joint structure can be smaller, and the joint structure is more suitable for moving in a pull-out space in which the pull-out tube moves. Under a premise of ensuring a flow rate in the joint structure, the diameter of the joint body 1 can be minimized, which is conducive to pulling out the pull-out tube. An appearance of the joint structure is neat, the integrity is good, the joint structure is more beautiful, and the joint structure is more conducive to manufacture.

The magnetic component 4 is sleeved on the outside of the joint body 1 by insert molding. The outside of the magnetic component 4 is partially encased in the joint body 1, and the magnetic component 4 is partially exposed outside the joint body 1 to form the exposed space 6, so that when the joint body 1 is in a mould, the exposed space 6 can be used as an area where a mold positioning column passes through. The exposed space 6 has a function of avoiding the mold positioning column, which facilitates positioning of the magnetic component 4 during the first insert molding. After the second insert molding, the exposed space 6 can be covered, an overall appearance is simple and beautiful, the magnetic component 4 will not be exposed, and the magnetic component 4 does not need to be positioned again during the second insert molding.

A part of the joint body 1 encasing the outside of the magnetic component 4 comprises a first connecting flange 11 and a plurality of first encasing walls 12. The first connecting flange 11 is formed on one end of the magnetic component 4 along the axial direction of the joint structure. The plurality of first encasing walls 12 encase an outer wall of the magnetic component 4. One end of the plurality of first encasing walls 12 is connected to the first connecting flange 11. The plurality of first encasing walls 12 are arranged at intervals along a circumferential direction of the magnetic component 4, and gaps between two adjacent first encasing walls 12 of the plurality of first encasing walls 12 form the exposed space 6. In this embodiment, the first connecting flange 11 is annular, and the plurality of first encasing walls 12 are arc-shaped walls. In this embodiment, the plurality of first encasing walls 12 are two first encasing walls 12, and the two first encasing walls 12 are arranged at an interval of 180 degrees.

The embedded member 5 comprises a second connecting flange 51 and a plurality of second encasing walls 52. The second connecting flange 51 is formed on a second end of the magnetic component 4 in the axial direction of the joint structure. The plurality of second encasing walls 52 encases the outer wall of the magnetic component 4. One end of the plurality of second encasing walls 52 is connected to the second connecting flange 51. The plurality of second encasing walls 52 are formed between the two adjacent first encasing walls 12 of the plurality of first encasing walls 12 to be fixedly connected to the plurality of first encasing walls 12. In this embodiment, the second connecting flange 51 is annular, and each of the plurality of the second encasing walls 52 is in the shape of an arc-shaped wall. In this embodiment, the plurality of second encasing walls 52 are two second encasing walls 52, and the two second encasing walls 52 are arranged at an interval of 180 degrees.

An outer wall of the plurality of first encasing walls 12 is flush with an outer wall of the plurality of second encasing walls 52. The plurality of first encasing walls 12 and the plurality of second encasing walls 52 form a cylindrical structure 8, and a diameter of the cylindrical structure 8 is the same as an outer diameter of the pull-out tube. The cylindrical structure 8 formed by the plurality of first encasing walls 12 and the plurality of second encasing walls 52 matches to the outer diameter of the pull-out tube. Since the diameter of the joint structure can be made smaller, the outer diameter of the pull-out tube can also be made smaller, and the outer diameter of the pull-out tube does not need to be adjusted based on the diameter of the joint structure.

An inner wall of the magnetic component 4 is embedded in the joint body 1, and the outer wall of the magnetic component 4 is embedded in the plurality of first encasing walls 12 and the plurality of second encasing walls 52, so that the diameter of the joint body 1 can be reduced.

Figure 7:
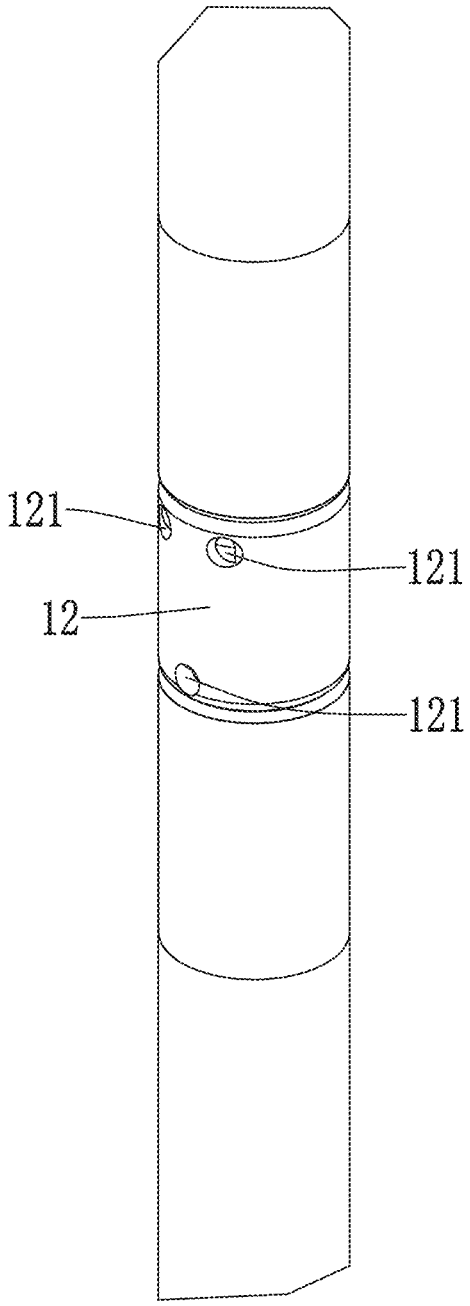
FIG. 7 is a perspective view of the joint structure and two segmented pull-out tubes of a pull-out tube using only one insert molding.

Refer to FIG. 7, a structure that has undergone only one insert molding is shown. In this structure, since an insert (i.e., the magnetic component 4) needs to be positioned in the mould, the mould has a mold positioning column abutting the magnetic component 4. After the insert molding is performed, a positioning hole 121 is formed on a wall of the joint body encasing the magnetic component 4. This structure can be formed by only one insert molding, and the process is simple.

The present disclosure also provides a pull-out tube structure, and the pull-out tube structure comprises the pull-out tube and the joint structure. The pull-out tube comprises a first tube section 71 and a second tube section 72, and the two connecting heads 2 of the joint structure are respectively inserted into the first tube section 71 and the second tube section 72.

Figure 8:
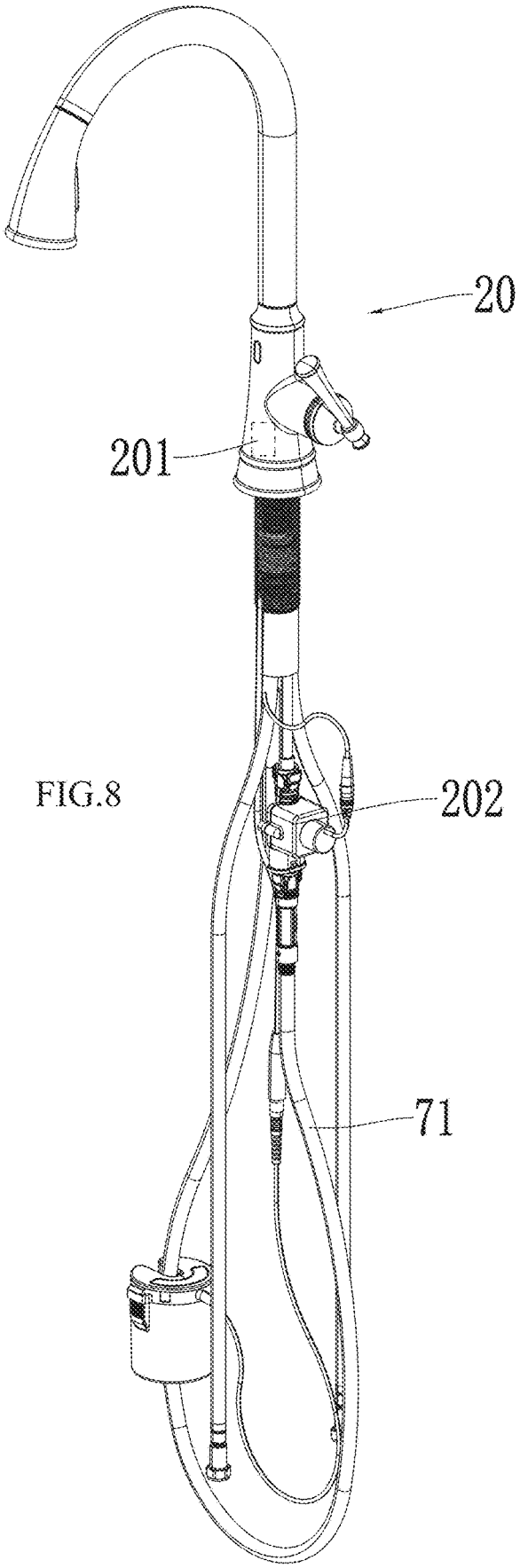
FIG. 8 is a perspective view of a faucet in the preferred embodiment of the present disclosure.

Referring to FIG. 8, the present disclosure also provides a faucet 20, and the faucet 20 comprises the pull-out tube structure. The faucet 20 comprises a magnetic switch 201, and the magnetic component 4 of the pull-out tube structure is configured to correspond to the magnetic switch 201. The faucet 20 further comprises a solenoid valve 202 for controlling whether the pull-out tube structure of the faucet 20 is supplied with water, and a pull-out head is connected to a water outlet end of the pull-out tube structure. The magnetic switch 201 is connected to a faucet body of the faucet 20. When the pull-out head is in an initial position, the magnetic switch 201 senses magnetism of the magnetic component 4 and controls the solenoid valve 202 to be turned off, so that the pull-out head does not discharge water. When the user pulls the pull-out head and drives the pull-out tube structure to move, the magnetic component 4 moves with the pull-out tube structure, so that the magnetic switch 201 cannot sense the magnetism of the magnetic component 4. At this time, the magnetic switch 201 controls the solenoid valve 202 to be turned on and the pull-out head discharges water. In this embodiment, the magnetic component 4 is a magnet.

The aforementioned embodiments are merely some embodiments of the present disclosure, and the scope of the disclosure is not limited thereto. Thus, it is intended that the present disclosure cover any modifications and variations of the presently presented embodiments provided they are made without departing from the appended claims and the specification of the present disclosure.

What is claimed is:

1. A joint structure configured for a pull-out tube, comprising:

a joint body, two connecting heads respectively disposed on two ends of the joint body, a magnetic component, and an embedded member, wherein:

the two connecting heads are configured to be connected to the pull-out tube, the magnetic component is sleeved on an outside of the joint body by a first insert molding process, an outside of the magnetic component is partially encased in the joint body, the magnetic component is partially exposed outside the joint body to form an exposed space, the embedded member is molded on the exposed space by a second insert molding process, and the joint body and the embedded member are combined to encase the magnetic component.

2. The joint structure configured for the pull-out tube according to claim 1, wherein:

a part of the joint body encasing the outside of the magnetic component comprises a first connecting flange and a plurality of first encasing walls, the first connecting flange is formed on one end of the magnetic component along an axial direction of the joint structure, the plurality of first encasing walls encase an outer wall of the magnetic component, one end of the plurality of first encasing walls is connected to the first connecting flange, the plurality of first encasing walls are arranged at intervals along a circumferential direction of the magnetic component, and gaps between two adjacent first encasing walls of the plurality of first encasing walls form the exposed space.

3. The joint structure configured for the pull-out tube according to claim 2, wherein:

the embedded member comprises a second connecting flange and a plurality of second encasing walls, the second connecting flange is formed on a second end of the magnetic component in the axial direction of the joint structure, the plurality of second encasing walls encase the outer wall of the magnetic component, one end of the plurality of second encasing walls is connected to the second connecting flange, the plurality of second encasing walls are formed between the two adjacent first encasing walls of the plurality of first encasing walls to be fixedly connected to the plurality of first encasing walls.

4. The joint structure configured for the pull-out tube according to claim 3, wherein:

an outer wall of the plurality of first encasing walls is flush with an outer wall of the plurality of second encasing walls.

5. The joint structure configured for the pull-out tube according to claim 4, wherein:

the plurality of first encasing walls and the plurality of second encasing walls form a cylindrical structure, and a diameter of the cylindrical structure is the same as an outer diameter of the pull-out tube.

6. The joint structure configured for the pull-out tube according to claim 3, wherein:

an inner wall of the magnetic component is embedded in the joint body, and the outer wall of the magnetic component is embedded in the plurality of first encasing walls and the plurality of second encasing walls.

7. A pull-out tube structure, comprising the pull-out tube and the joint structure according to claim 1, wherein:

the pull-out tube comprises a first tube section and a second tube section, and the two connecting heads of the joint structure are respectively disposed in the first tube section and the second tube section.

8. A faucet, comprising:

the pull-out tube structure according to claim 7, and a magnetic switch, wherein:

the magnetic component of the pull-out tube structure is configured to correspond to the magnetic switch.

9. A joint structure configured for a pull-out tube, comprising:

a joint body, and two connecting heads respectively disposed on two ends of the joint body, and a magnetic component, wherein:

the two connecting heads are configured to be connected to the pull-out tube, the magnetic component is sleeved on an outside of the joint body by an insert molding process, the joint body entirely encases an outside of the magnetic component, one or more positioning holes exposing the magnetic component are formed on the joint body during the insert molding process, and the one or more positioning holes are configured to enable a mould to position the magnetic component.

10. A pull-out tube structure, comprising the pull-out tube and the joint structure according to claim 9, wherein:

the pull-out tube comprises a first tube section and a second tube section, and the two connecting heads of the joint structure are respectively disposed in the first tube section and the second tube section.

* * * * *